US005149061A

United States Patent [19]

Borgnini

[11] Patent Number: 5,149,061

[45] Date of Patent: Sep. 22, 1992

[54] PANEL FOR ROAD CONSTRUCTION

[76] Inventor: Arsenio Borgnini, Via Alcide De Gasperi, 38, Valfabbrica (PG)

[21] Appl. No.: 750,286

[22] Filed: Aug. 27, 1991

[51] Int. Cl.[5] ..... E04H 17/16

[52] U.S. Cl. ..... 256/24; 256/13.1; 404/12

[58] Field of Search ..... 256/13.1, 24; 404/12, 404/13

[56] References Cited

U.S. PATENT DOCUMENTS

| | | | |
|---|---|---|---|
| 3,234,697 | 2/1966 | Toti et al. | 256/24 X |
| 4,295,637 | 10/1981 | Hulek | 256/13.1 |
| 4,306,631 | 12/1981 | Reusser | 256/24 X |
| 4,312,166 | 1/1982 | Mock | 256/24 X |
| 4,338,041 | 7/1982 | Schmanski | 256/13.1 X |
| 4,751,893 | 6/1988 | Brantley | 256/13.1 X |
| 5,015,119 | 5/1991 | Schmanski | 256/13.1 X |

FOREIGN PATENT DOCUMENTS

| | | | |
|---|---|---|---|
| 2821349 | 11/1979 | Fed. Rep. of Germany | 256/13.1 |
| 2540533 | 8/1984 | France | 256/13.1 |

*Primary Examiner*—Andrew V. Kundrat
*Attorney, Agent, or Firm*—Leonard Bloom

[57] ABSTRACT

The present invention concerns a panel with a horizontal or vertical transverse ridged cross-section, that can be interconnected in sucession with other panels of the same type to form a continuous screen which is installed above the central barrier separating the two carriageways of a road, or above the barriers that delimit the sides of a road; this screen, particularly when installed above the central barrier of a road, being designed to be capable of simultaneously acting to screen off full beam headlamps and spray from wet road surfaces from the opposing carriageways of a road, and to act as a reference at night and/or in conditions of poor visibility, due to the high refractive power of its surfaces.

8 Claims, 5 Drawing Sheets

PANEL FOR ROAD CONSTRUCTION

DESCRIPTION

The object of the present patent application is a ridged panel that can be assembled in succession with other panels of the same type to form a continuous screen which is installed above the central barrier separating the two carriageways of a road, or above the barriers that delimit the sides of a road.

The continuous screen that is formed by panels of the type according to the invention is characterized by the considerable ease with which it can be assembled and maintained, and its ability to give excellent results in terms of traffic safety in conditions of poor visibility caused by fog, or at night, or when both conditions prevail.

The screen according to the invention has been designed following careful research into the traffic problems that are a feature of major roads, particularly dual carriageways, at night and/or in the presence of thick fog or mist.

One of the major problems affecting road users today is the risk, on almost all dual carriageway roads, of being dazzled by the headlamps of oncoming vehicles. This is problem which cannot even be avoided by the use of guard-rail or New Jersey type central barriers, as they are designed to prevent vehicles from crossing into the opposing carriageway, and their height, which is defined on the basis of international standards, is insufficient for them to simultaneously effectively screen off the headlamps of vehicles moving in opposite directions from each other.

In order to resolve this problem, screening elements to be attached above central barriers have already been constructed. However, they have always been elements that are separate from each other, and as such, are unable to prevent light from passing between them as two vehicles travelling in opposite directions approach each other and the angle of light from their headlamps changes.

It should also be added that all structures with non-continuous elements that are installed at the side of a road, and thus also these types of screening elements, create an irritating and distracting noise caused by the movement of air striking them.

These problems mean that a driver has to continually modify his own position and behaviour, with a considerable expenditure of mechanical, physical, and mental energy, and when the human eye is suddenly struck by an intensely dazzling light it is blinded, sometimes for several seconds.

In designing the panel in question, a second function was also taken into consideration, making the panels even more important and useful. The continuous screen they produce can be coloured with a paint containing a highly reflective pigment, or coated with a reflecting and/or phosphorescent and/or fluorescent plastic film so that it reflects and/or captures existing light and is self-illuminating.

The effect created by painting or coating the screen in the above manner is particularly advantageous, especially in correspondence with the ridges that project from the flat surfaces of the panels. As the flat surfaces of the panels cannot be directly struck by light from headlamps on vehicles that are travelling parallel to them, they therefor do not produce the desired self-illuminating effect. This effect is produced by the aforementioned ridges which, as they project from the surface of the panel, are directly hit, almost perpendicularly, by the beams of light coming from headlamps and thus become highly visible.

The continuous screen thus acts as an effective guide to drivers, and as it is highly reflective it, is extremely useful in thick fog or conditions where visibility is greatly reduced, such as at night.

The continuous screen obtained using a number of panels according to the invention can be painted in a main colour that is interspersed with equidistantly spaced strips of a second colour that provide a measurement for adapting the speed of a vehicle to visibility conditions, and the screen can be either white or yellow (the type of colour used for markings on the carriageway itself) in colour, and highly reflective it, depending on whether it has been installed to solve the problem of driving in fog or simply to aid night driving, especially where there is no street lighting.

It should also be pointed out that the paintwork on the panels in question is capable of being extremely long lasting and of maintaining its function as an aid to driving visibility. The same cannot be said, however, of the markings on the carriageway itself existing today. Although they are extremely useful, they require assiduous and somewhat frequent maintenance, not to mention the various types of cats-eyes placed on the barriers and/or sides of a road that after the first rainy day become covered in mud and dust and thus lose all their effectiveness.

From a technical point of view, the article according to the invention is composed of a ridged panel that can be constructed to the most suitable height, as they can be of a standard height or variable height depending on the level maintained by the carriageway. The ridges give the panels the necessary rigidity and stability to resist wind pressure or movements of air caused by the passage of heavy vehicles, these panels being capable in any case of maintaining a certain degree of elasticity resulting in a slight vibration, and it can be readily imagined how these small vibrations of the refracting surfaces can have a pleasurably exciting effect on drivers, which manifests itself as an increase in the attention paid to driving and improved reflexes.

For greater clarity, the description of the invention continues with reference to the attached drawings, which are solely for the purpose of illustrating the invention and do not limit it in any way.

FIGS. 4, 5, 6, 7, 8, and 9 show some of the possible ways the panel in question can be installed on a single or double guard-rail or New Jersey type barrier.

Figure 10:
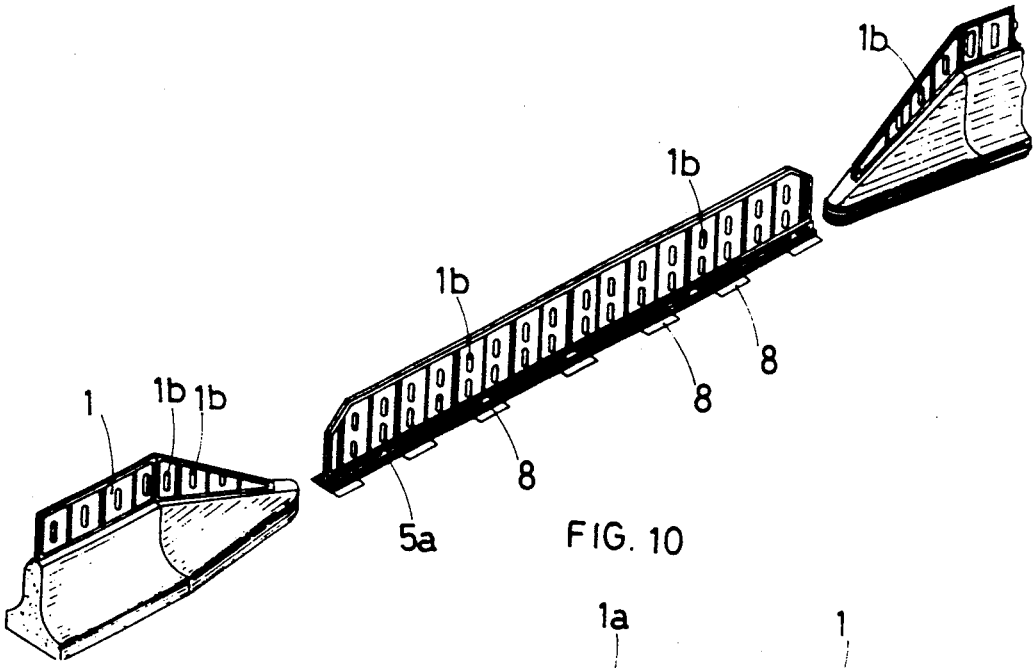

FIG. 10 shows a panel according to the invention attached directly to the ground between two interrupted sections of New Jersey type barrier.

Figure 11:
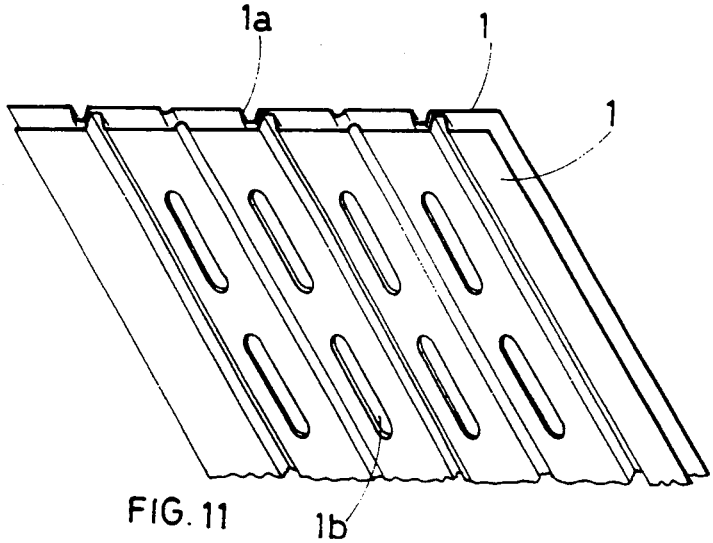
Figure 12:
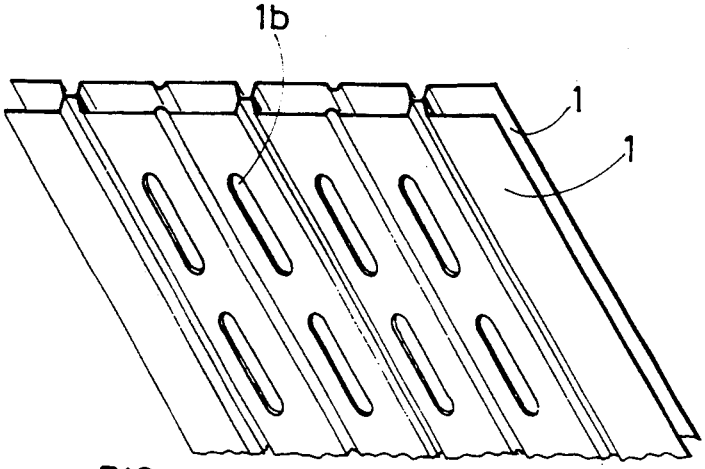

FIGS. 11 and 12 are axonometric views of two-layer panels characterized by the fact that they each have a series of slots positioned parallel to their ridges.

Figure 13:
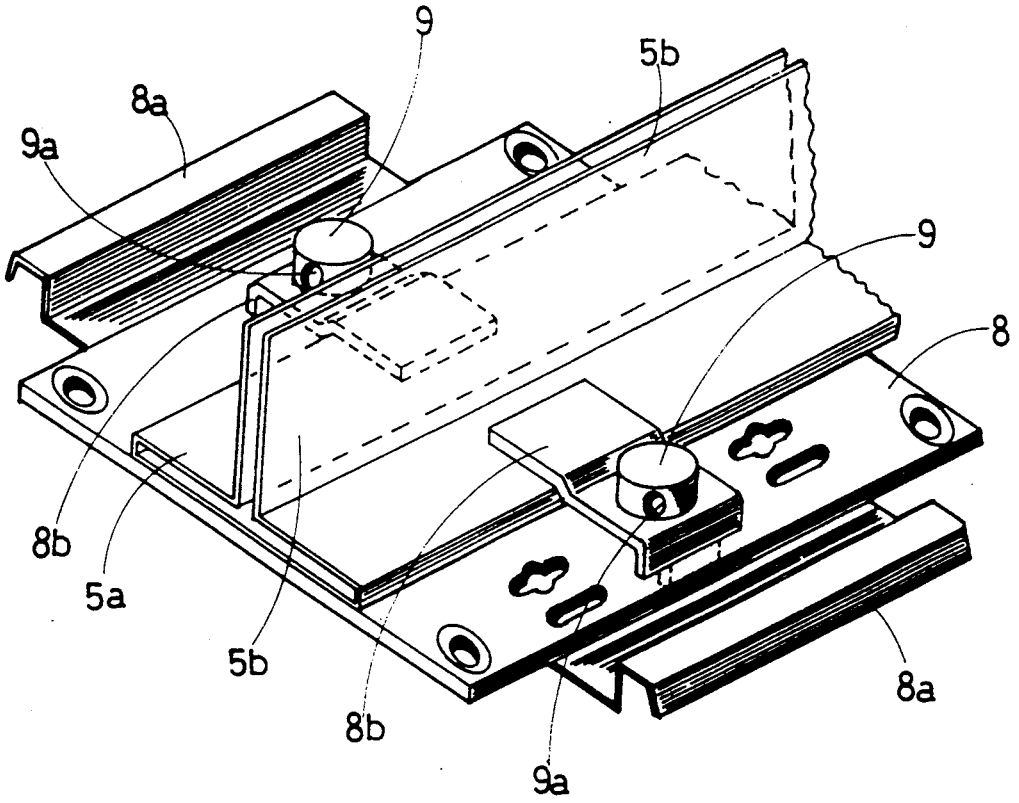
Figure 14:
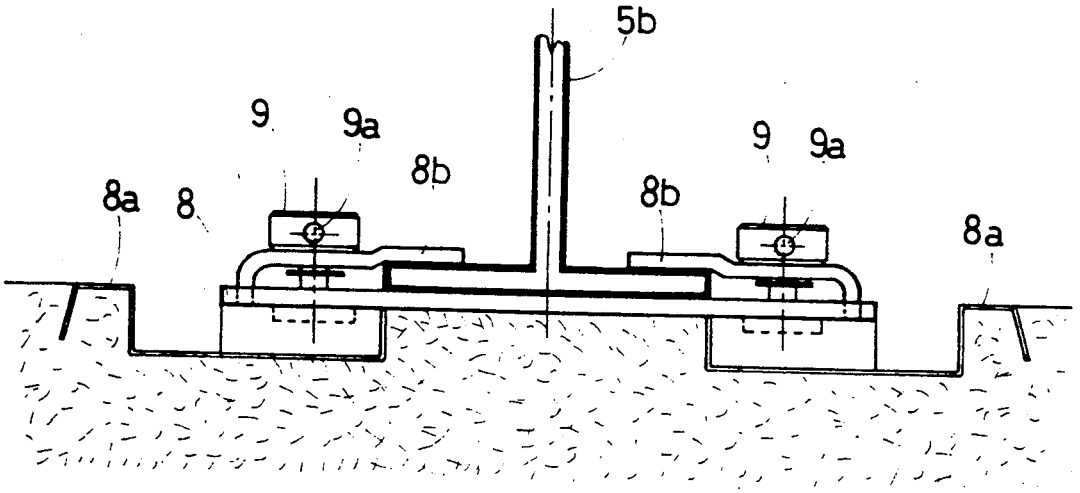

FIGS. 13 and 14 are respectively an axonometric and front view of the means used to attach a panel according to the invention directly to the ground.

Figure 1:
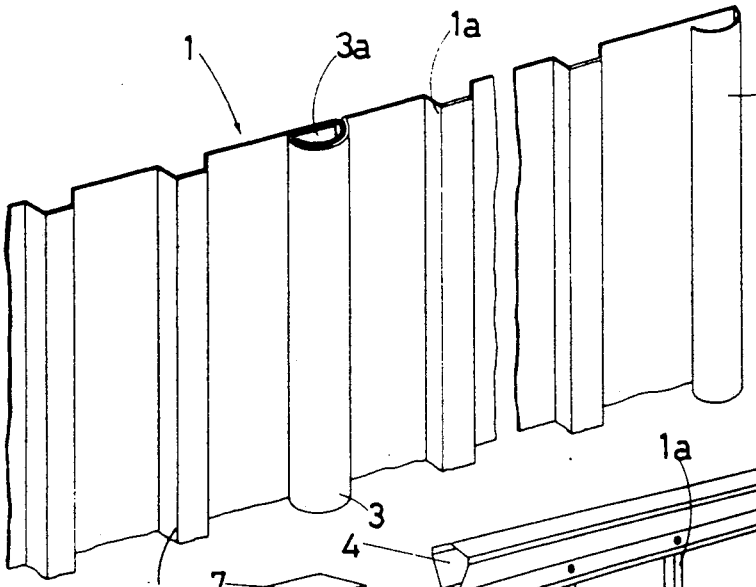
FIG. 1 is an axonometric view of a panel according to the invention connected to another panel of the same type.

With particular reference to FIG. 1, the article according to the invention consists of a metal or plastic panel (1) in the surfaces of which there are formed as a part thereof a number of ridges (1*a*) that are rectangular or trapezoid in section and spaced at regular intervals, and one of the transverse edges (2) of the panel (1) is formed extending forwardly away from the external face of the panel and then bent back and towards the external face, that from which the aforementioned ridges (1*a*) project, of the article itself (1) so as to be substantially semi-circular in shape with a cavity defined therein that is partially closed by the exterior face of the panel. As is seen in the drawings, the said one of the traverse edges further terminates short of the exterior face of the panel, such that a slot is defined therebetween for permitting access into the said cavity. The opposing edge (the other of the traverse edges of the panel) (3) is as is seen in the drawings, formed extending forwardly away from the external face and then being bent backwardly away from the external face, so as to be substantially semi-circular in shape with an open cavity defined thereby that is almost closed by an end tab (3*a*) that is on the same plane as the flat surface of the panel extending towards the panel, such that the said end tab substantially closes the open cavity formed on the other of the traverse edges of the panel.

The transverse edges (2 and 3) of the panel (1) are so shaped that a large number of panels according to the invention can be consecutively attached to each other in a simple but stable fashion. This is made possible by the fact that the semicircular shaped end part (3) of one panel (a first adjoining panel) is capable of externally fitting around the semicircular edge part (2) of a consecutive panel, and its end tab (3*a*) is capable of being inserted into and being permanently locked between the semicircular edge part (2) and actual surface of this second panel. (This type of coupling is shown in FIG. 1).

For further clarity and to be more precise, this type of coupling between one panel and the next can be achieved by inserting the edge part (3) of the first panel downwards into the edge part (2) of the second (a second adjoining panel).

It should be pointed out that using this assembly system a continuous screen of these panels (1) can be constructed that has the appearance and functionality of a single monolithic screen.

Figure 2:
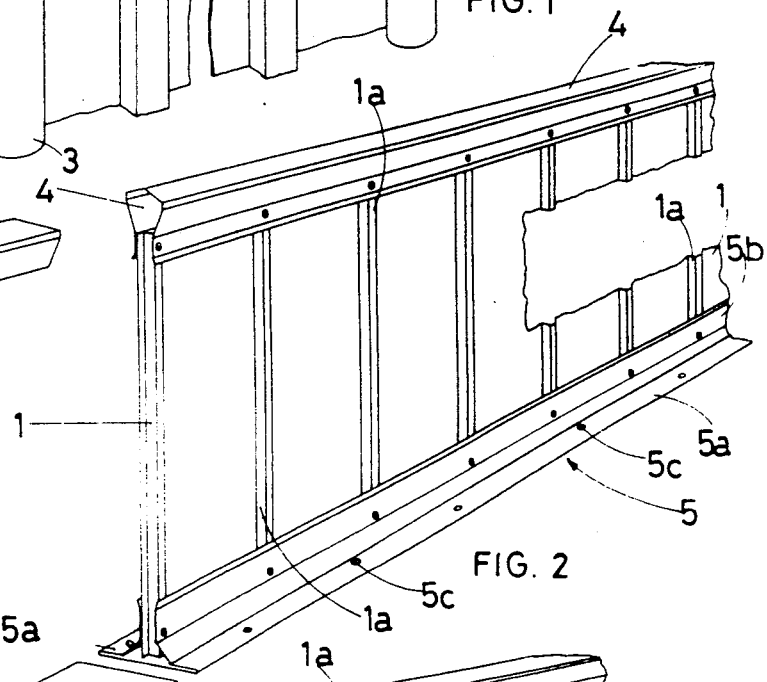
FIGS. 2 and 3 are axonometric views of two alternative, and equivalent from a functional point of view, versions of the way a panel according to the invention can be constructed.
Figure 3:
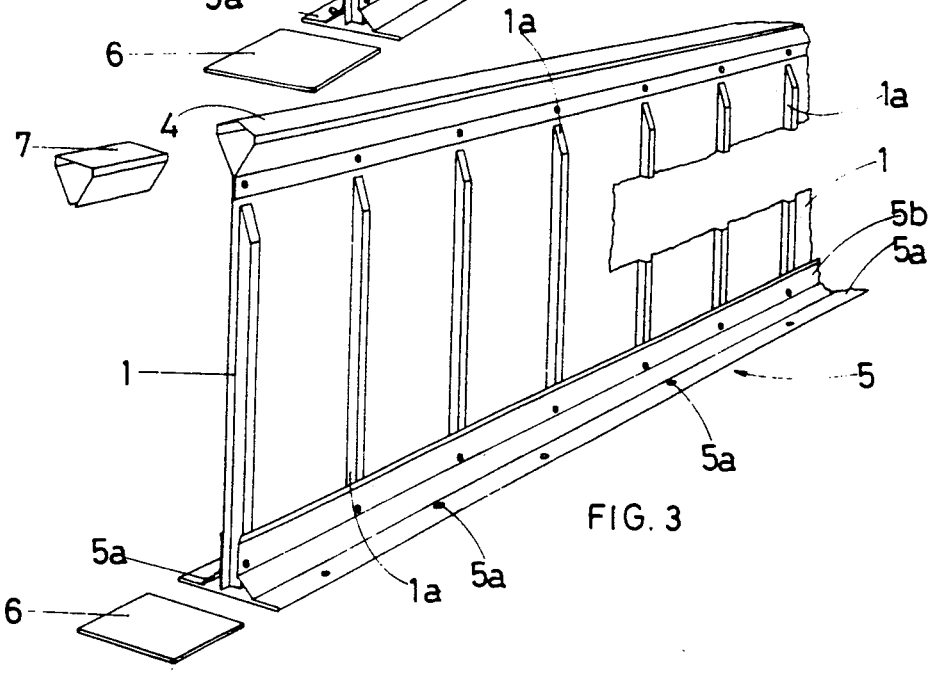

FIG. 2 shows a version of the article in question (1) in which the lateral ridges (1*a*) extend for the entire height of the panel, and FIG. 3 shows a version with lateral ridges (1*a*) that do not extend to the top of the panel (1).

It can anyway be seen that in both cases the upper part of the panel (1) is finished by a flashing (4) with an upturned (inverted) 'U' shaped cross-section whose opposing walls have to be fixed to the two faces of the same panel (1), directly in correspondence with their surfaces as shown in FIG. 3, or in correspondence with the ridges (1*a*) as shown in FIG. 2.

As explained earlier, these panels (1) are to be vertically attached to the top of a traffic barrier, and for this reason they are designed to be supported in this position by a special support moulding (5) with an upturned 'T' shaped cross-section that has a large base surface (base stabilizing plate) (5*a*) at the centre of which there is a vertically projecting guide (5*b*) having a guide space formed therein. In this manner, as is seen in the drawings, the bottom of the panel may be received in the guide space between whose sides the lengthwise lower edge of the panel (1) in question can be securely held attached.

It should be pointed out that these support mouldings are normally fitted with drainage holes (5*c*).

These same figures also show a foot plate (6) used to connect two consecutive lengths of support moulding (5), and a sleeve (7) used to connect two consecutive lengths of the upper upturned 'U' shaped flashing (4).

The article described (1) is perfectly suitable for various types of barrier including guard-rails, New Jersey type barriers, and other types of retaining walls, and its versatility is also due to the aforementioned support moulding (2) which can be easily and stably attached to any type of barrier.

Figure 4:
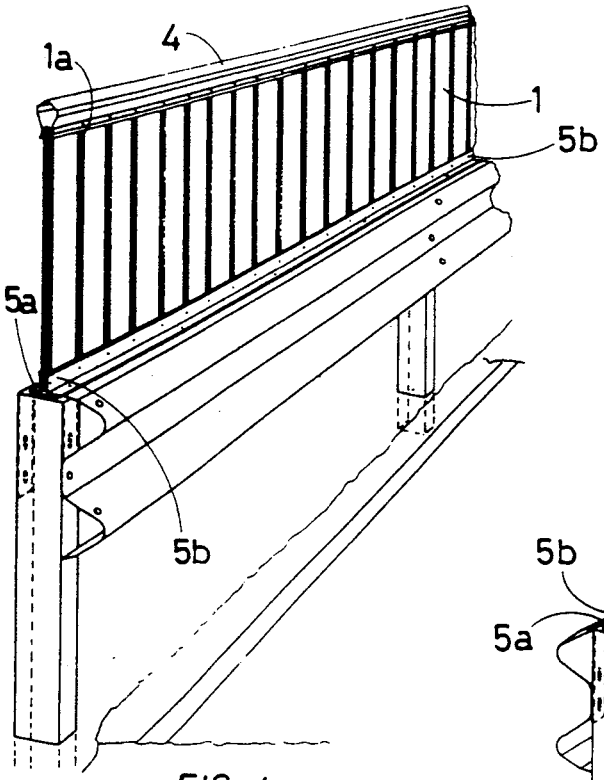
Figure 5:
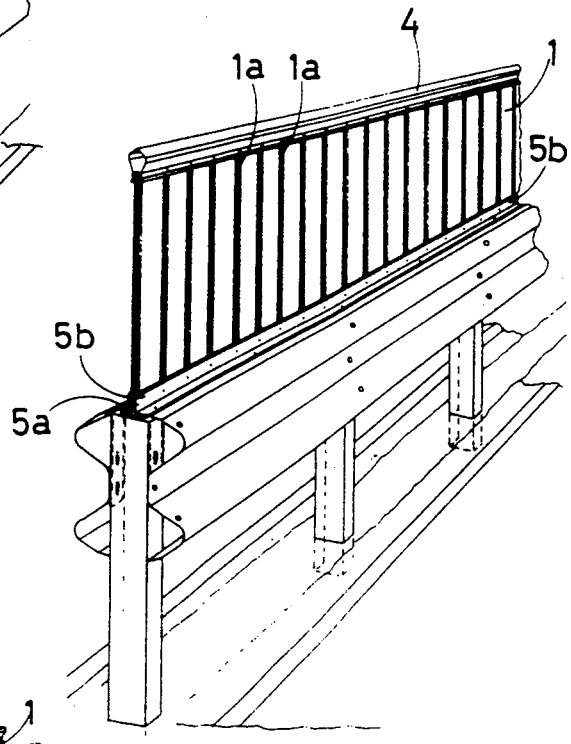
Figure 6:
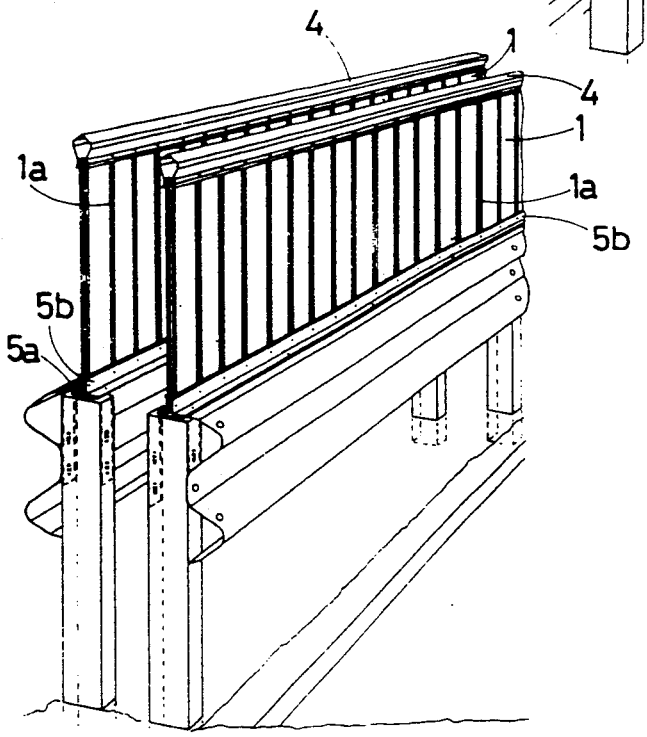

This support moulding (2) can in fact be advantageously attached to the top of any type of guard-rail type barrier using the same support struts that the barrier itself is attached to, and FIGS. 4, 5, and 6 respectively show the moulding (2) and panel above it (1) attached to: a single one-sided guard-rail, a single double-sided guard-rail, and on a double guard-rail used to separate traffic flows when the two carriageways are of at different levels, even for short distances, or when there are trees or bushes between the two barriers on a central reservation. In particular, it is adviseable to use the panels in question even where there are trees or bushes between the two barriers on a central reservation as this vegetation is by itself unable to completely screen of headlamp beams from vehicles, particularly as the environmental conditions of a heavily used road are not ideal for keeping and growing plants, and in any case, they cannot be of any aid in highlighting the side of the road to drivers in fog or poor visiblilty, and can even have the opposite effect.

Figure 8:
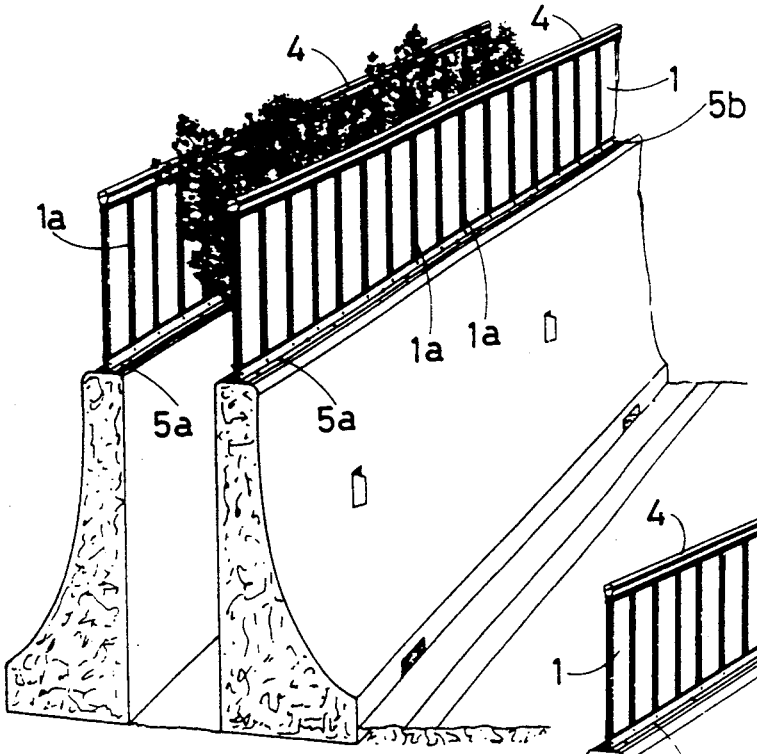
Figure 7:
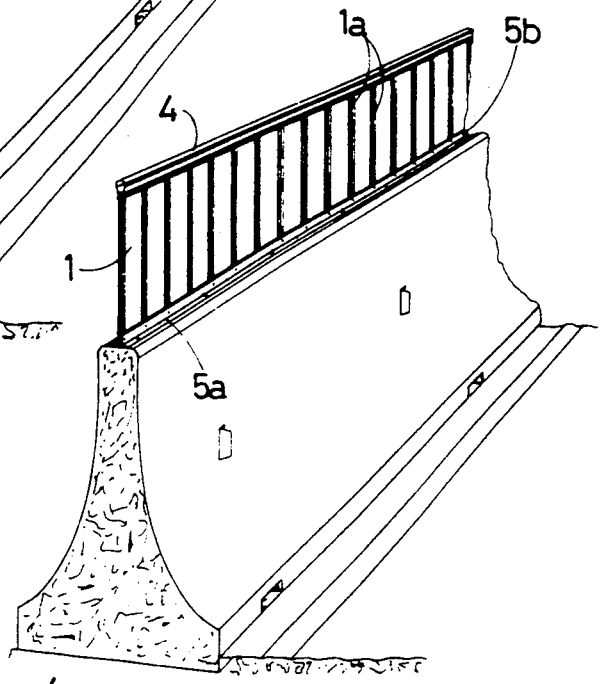
Figure 9:
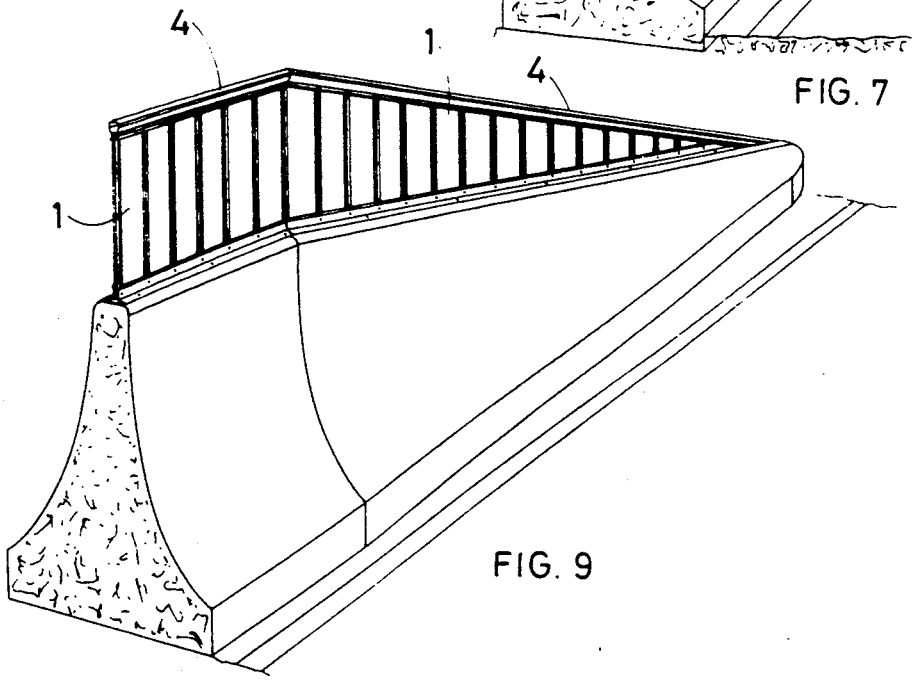

The article in question is even easier to install on the top of single or double New Jersey type barriers (see FIGS. 7 and 8).

The continuous screen that can be obtained using a number of panels (1) of the type in question has a large number of advantages, especially when compared to previously used systems.

It has, for example, to be said that other screening systems, with separate elements set at angles that are specially researched for each section of road on the basis of the imaginary line traced by the ideal trajectory under normal conditions, have in practice performed far less well than was estimated or expected.

On the other hand, with use of a continuous screen such as that obtained using a number of panels of the type in question, which are capable of being adapted to any road conditions and type of barrier, optimum performance is ensured.

Among other things, this type of continuous screen, aside from preventing drivers being dazzled by headlamps on oncoming vehicles, simultaneously functions as an insurmountable barrier between carriageways against water being sprayed from puddles and wet road surfaces by vehicles travelling in opposite directions. No other barrier screen is capable of protecting one carriageway from water sprayed from the other.

It can thus be said that the invention allows drivers to exclusively concentrate on the carriageway on which they are travelling, without having to worry about disturbing or being disturbed by vehicles on the other carriageway, as the carriageway is completely isolated by the continuous screen obtained using panels according to the invention, and a driver can even travel with full beam headlamps continually on, provided there are no other vehicles travelling on the same carriageway.

If the panels in question are attached to the top of a barrier delimiting the right hand side of a carriageway, aside from functioning as a reference to vehicles, they can also provide some protection to residential areas adjacent to the road by screening them off from irritating beams from headlamps, especially if these buildings are at a tangent to a curve or semi-curve in the roadway.

It should also be pointed out that the article described here takes up little space and is extremely durable.

It takes up little space in as much as it is in any case far narrower than the barrier on which it is installed, and thus creates no particular danger if a vehicle rubs against or crashes into the barrier, unlike the extremely dangerous screening systems using separate elements.

Its considerable resistance derives from the special ribbing on its surface that makes it stable even in the presence of strong winds.

A special version of the panel in question has also been designed for use in extremely windy areas that is capable of resisting wind pressure even in situations where wind pressure is considerably above average. In this case, there are a number of oblong slots (1*b*) in the panel (1) that are not only capable of reducing the effect of wind, but also allow vehicles travelling in the opposite direction to be seen (thus eliminating the unpleasant 'wall effect' that a panel with a continuous surface can have), without, however, allowing the passage of headlamp beams. (See the article shown in FIGS. 10, 11, and 12).

Whenever the screen is to be installed in exceptionally windy areas, it can be constructed of a double box-type structure with an extraordinary total structural strength, by using two single panels (1) fitted side by side. In particular, FIG. 12 shows a double panel in which the ribbing (1*a*) of the two components is opposed in a mirror fashion, whereas FIG. 11 shows a double panel in which the two components have been assembled with their ribbing staggered in respect of each other. These panels with a box-type structure are so resistant and effective that they can be used as a real and proper windbreak.

Their structural strength is above all due to the materials from which they are constructed, which have been found to be immune to the 'crystallizing' action of ageing caused by atmospheric agents. This feature is especially advantageous, and these barriers are not easily broken up and pieces of them are not distributed over the road surface if a vehicle crashes into them, as currently happens, at great risk to vehicles later arriving at the scene of an accident.

The fact that barriers made up of a number of panels of a type according to the invention cannot be broken up is due to the stability of the joints between them created by inserting their aforementioned respective and correspondingly shaped transverse edges. This safe and durable coupling system ensures that the panels do not separate or break up even following the most violent impact, but at worst they deform by contraction or stretching, without this covering the road surface with dangerous debris.

As to the duration of the effect of the invention of delimiting the carriageway and acting as a driving guide, it should be said that the article in question is treated with special highly resistant paints that are particularly brilliantly coloured and resistant to external agents. They are also capable of a certain degree of self-cleaning when it rains, but in any case can be easily and continuously cleaned using the specially designed automatic machine that is the subject of Italian Patent Application 17923 A/89 belonging to the same person as the present patent application.

The advantages of this invention are completed by two further safety and functional features, which are not directly aimed at motor vehicle drivers, but at other road users. A barrier constructed of panels of the type described here is free of gaps and totally free of projections and hand or foot holds of any description, making it a practically insurmountable obstacle to those unwise pedestrians that climb over the central barriers and cross dual carriageways near built up areas and service stations.

The article according to the invention can also be installed directly on the ground (see FIG. 10) on existing by-passes between the end of one central barrier and the start of the next, thus preventing unwise drivers from carrying out dangerous 'U' turns where they are in any case prohibited.

In this last case, the article is attached to the ground in such a way that those manning emergency vehicles can easily remove it should they need to change carriageway in order to reach the scene of an accident as fast as possible.

This is made possible by anchoring the barrier to the ground using a special device (shown in FIGS. 13 and 14) made up of a pre-drilled plate (8) with shaped lower slats (8*a*) for attaching it to the ground, and two holding plates (8*a*) that grip the support moulding (5) of the invention and can be easily locked and loosened by two rotating eccentric bolts (9) that can be turned using any type of punch or screwdriver via holes (9*a*) drilled right through the aforementioned bolts (9).

I claim:

1. A rigid panel that can be stably assembled in succession with identical panels that are positioned adjoining thereto, so as to form a continuous screen installed lengthwise above road barriers, the panel, in combination, comprised of:

a metal panel having an external face, a top, a bottom, and a pair of opposite traverse edges;

a plurality of ridges formed on the external face of the panel, so as to project outwardly from the external face, the ridges being spaced from one another at regular intervals along the panel, and each of said ridges being substantially U-shaped in cross-section;

molded flashing being substantially inverted U-shaped in cross-section, the molded flashing being disposed on the top of the panel;

a substantially T-shaped support including a base stabilizing plate and a guide positioned at substantially the center thereof so as to project upwardly therefrom, the guide having a guide space formed therein, such that the bottom of the panel may be received in the guide space, so as to be securely held in the guide space by the guide;

one of the traverse edges of the panel formed extending forwardly away from the external face of the panel and then being bent backwardly towards the external face of the panel, so as to be substantially semi-circular in shape with a cavity defined therein that is partially closed by the external face of the panel, the one of the traverse edges further terminating short of the exterior face of the panel, such that a slot is defined therebetween for permitting access into the said cavity;

the other of the traverse edges of the panel formed extending forwardly away from the external face and then being bent backwardly away from the external face, so as to be substantially semi-circular in shape with an open cavity defined thereby;

an end tab formed on the other of the traverse edges of the panel and extending towards the panel, such that the said end tab substantially closes the open cavity formed on the other of the traverse edges of the panel;

the one of the traverse edges of the panel being of a size, such that an other of the traverse edges of a first adjoining panel fits therearound with the end tab of the other of the traverse edges of the first adjoining panel extending through the slot formed between the said one of the traverse edges and the exterior face of the panel, so as to be locked in place between the other of the traverse edge and the external face of the panel; and the other of the traverse edges of the panel being of a size, such that the said other of the traverse edges fits around a one of the traverse edges of a second adjoining panel with the end tab of the panel extending through the slot defined between the one of the traverse edges and the exterior face of the second adjoining panel, so as to be locked in place between the other of the traverse edge and the external face of the said second adjoining panel.

2. The combination of claim 1, further including a connecting plate disposed between and secured to both the stabilizing base plate of the panel and the stabilizing base plate of one of the adjoining panels, such that the panel and the one of the adjoining panels are further secured to one another, and a sleeve disposed between and secured to both the molded flashing of the panel and the molded flashing of one of the adjoining panels, such that the panel and the one of the adjoining panels are further secured to one another.

3. The combination of claim 1, wherein the panel is plastic.

4. The combination of claim 1, wherein the external face of the panel is a light color, so that the road is correctly and advantageously delimited.

5. The combination of claim 1, wherein the external face is self-illuminating.

6. The combination of claim 1, wherein the panel has slots formed in the external face, such that wind pressure on the panel is alleviated, and further such that at least partial vision through the panel is provided.

7. The combination of claim 1, further comprised of:

a plurality of foot plates carried by the stabilizing base plate, such that the panel may be directly placed on the ground.

8. The combination of claim 1, wherein the external face includes a first color and a second color, the second color being equidistantly interspersed with the first color, such that an exact measurement of speed on the basis of visibility conditions is provided.

* * * * *